United States Patent [19]

Dupont

[11] 4,399,934

[45] Aug. 23, 1983

[54] BELT ATTACHED CARRIER

[76] Inventor: Colyer L. Dupont, 537 Jones #898, San Francisco, Calif. 94102

[21] Appl. No.: 271,548

[22] Filed: Jun. 8, 1981

[51] Int. Cl.[3] ..... A45C 11/00

[52] U.S. Cl. ..... 224/240

[58] Field of Search ..... 224/228, 232, 236, 240, 224/246, 251, 253, 238, 239, 911, 914, 901, 223; D2/383, 400; 150/52 J, 47, 40

[56] References Cited

U.S. PATENT DOCUMENTS

| | | | |
|---|---|---|---|
| D. 255,509 | 6/1980 | Nathan et al. | D2/383 |
| D. 265,523 | 7/1982 | Mermer | D2/283 |
| 3,664,560 | 5/1972 | Perkins | 224/914 X |
| 3,813,017 | 5/1974 | Pimsleur | 150/52 J |

*Primary Examiner*—Steven M. Pollard
*Assistant Examiner*—David H. Voorhees
*Attorney, Agent, or Firm*—Victor R. Beckman

[57] ABSTRACT

A belt attached carrier and method of manufacturing the same are disclosed which carrier is adapted for suspension from a user's belt and may be used to carry a pocket knife, a container of mace, or the like. The carrier comprises an elongated tubular member formed from a single square or rectangular sheet of flexible material, which is open at one end and closed at the opposite end. A portion of the tubular member adjacent the open end thereof is formed into a belt-encircling loop for suspending the same from the user's belt with the open end thereof directed downwardly. First releasable fastening means releasably secure first and second portions of the tubular member together to form said loop. A portion of the tubular member adjacent the closed end thereof forms a combination closure flap and support for the article contained in the carrier. Second releasable fastening means releasably holds the closure flap in the closed condition. When the closure flap is opened the article contained in the carrier is free to slide outwardly therefrom under the influence of gravity.

4 Claims, 9 Drawing Figures

42
40
10
12
36

42
40
10
44
10B
32
12B
10A
12A
30
10

42
40
12A
30
44
10B
32
10A

BELT ATTACHED CARRIER

BACKGROUND OF THE INVENTION

Prior art belt attached carriers are, of course, well known. Generally, however, they are somewhat crudely designed and bulky. Often, they are made of leather and have a visual appearance which is unattractive. Also, it is often difficult to remove the item, or article, contained in the carrier therefrom.

SUMMARY OF THE INVENTION AND OBJECTS

An object of this invention is to provide a belt attached carrier incorporating features necessary to carry, enclose, protect and secure contents and making said contents readily accessible to the user, and to accomplish these goals using a novel design and method of construction.

Another object of this invention is to provide a belt attached carrier which is very simple in construction design and is easily and simply made with a minimum of labor and wasted materials, and therefore at low cost.

Another object of this invention is to provide a belt attached carrier which is very flexible and, therefore, readily conforms to the shape of the contents within the carrier and to different positions of the wearer thereby being convenient for the user and accommodating many different sizes and shapes of contents with very little excess space surrounding the contents.

Another object of this invention is to provide a belt attached carrier which may be attached and detached to a waist belt without partially or completely removing said belt, thereby being convenient for the user.

Another object of this invention is to provide a belt attached carrier designed specifically for construction using no metallic or animal related products, such as metal snaps or leather.

These objects are achieved by attaching a strip of fastening means of a first type, such as the male portion of "Velcro" fastening means along the one edge of a rectangular flexible sheet of material such as cloth, canvas, or the like. The sheet with attached fastener element is cut into a plurality of sections, each of which comprises a body of a carrier. Opposite free edges of the sheet section are secured together, as by stitching, as are opposite halves of the edge opposite said fastening element to provide a tubular member which is open at one end adjacent the fastening means and is closed at the opposite end. Fastening means of a second type, such as the cooperating female portion of "Velcro" fastening means, are attached to one side of the tubular member at a first location adjacent the closed end thereof and at a second location intermediate the open and closed ends of the tubular member. A portion of the fastening means adjacent the open end of the tubular member releasably engages the fastening means intermediate the opposite ends to form a belt encircling loop whereby the tubular member is supported on the belt with the open end extending downwardly. The article to be carried is insertable in the open end of the tubular member and is maintained therein by engagement of the fastening element adjacent the closed end of the tubular member with another portion of the fastening means adjacent the open end thereof.

BRIEF DESCRIPTION OF THE DRAWINGS

The invention, together with the above and other objects and advantages thereof, will become apparent from the following description together with the accompanying drawings. In the drawings, wherein the like reference characters refer to the same parts in the several views.

Figure 1:
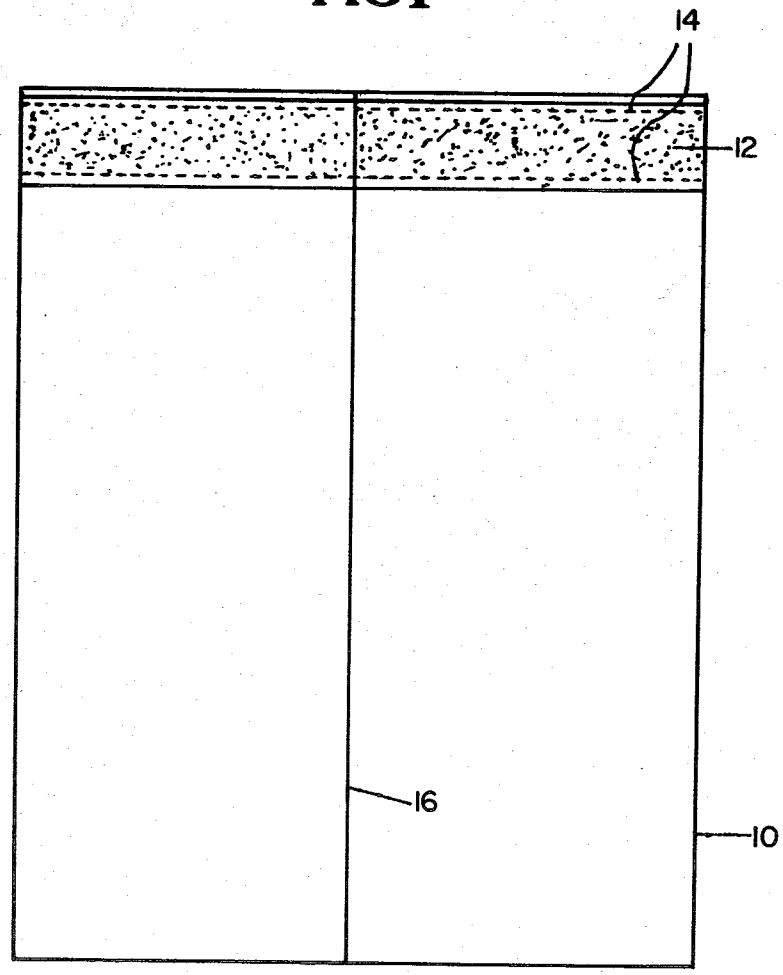
FIG. 1 is a plan view of a sheet of flexible material to which fastening means of a first type have been attached along one edge, from which sheet a plurality of carriers may be formed.
Figure 6:
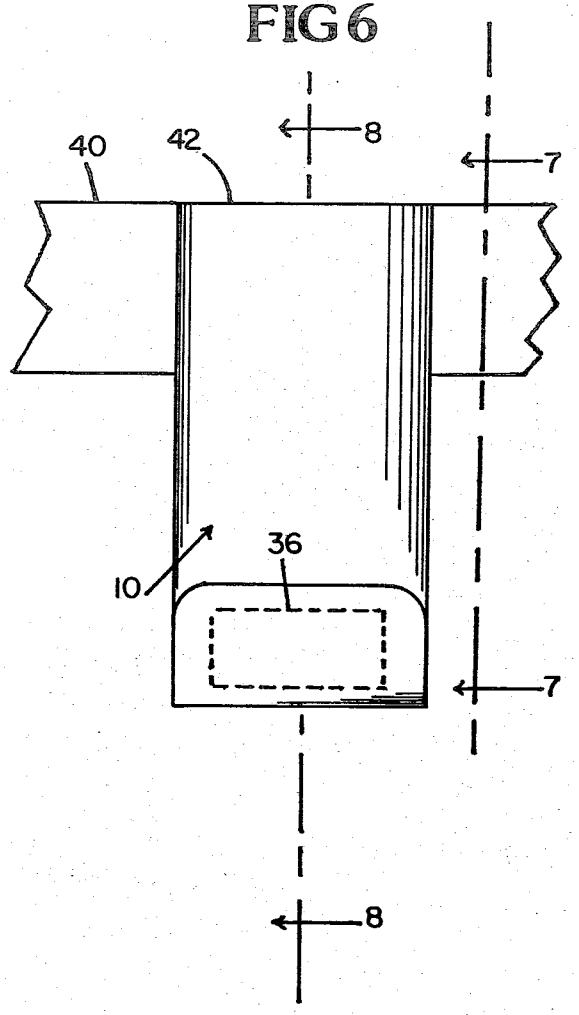
FIG. 6 is an enlarged view showing the carrier suspended from a belt.

Reference first is made to FIG. 1 wherein a flexible sheet of material such as cloth, or cloth-like material, 10 is shown to which a strip of releasable fastening means 12 is attached along one edge thereof as by stitching 14. Suitable fastening means include the type presently marketed under the tradename "Velcro", which comprises complimentary hook and loop elements characterized by their ability to cling to each other when pressed together. Here, a strip 12 of hook material is shown attached to one edge of the sheet 10. The sheet 10 is of sufficient size to form a plurality of carriers, here two carriers; the sheet being cut along line 16 to form two separate carrier bodies or blanks, with attached fastening means.

Figure 3:
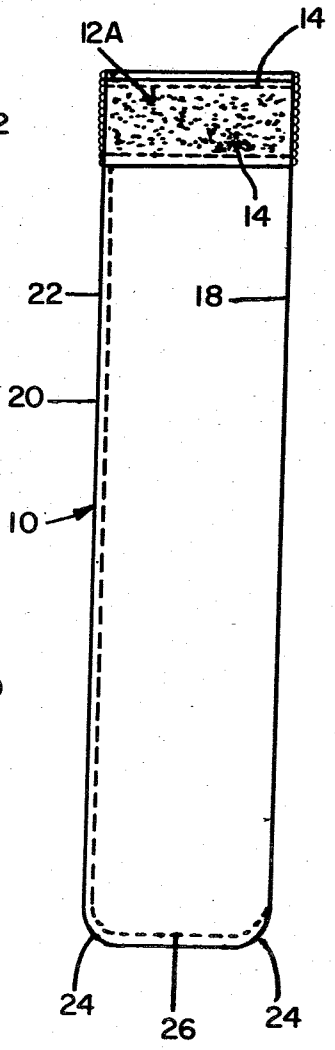
FIG. 3 is a view which is similar to that of FIG. 2 but showing the sheet folded longitudinally and edges attached to form a tubular member.
Figure 2:
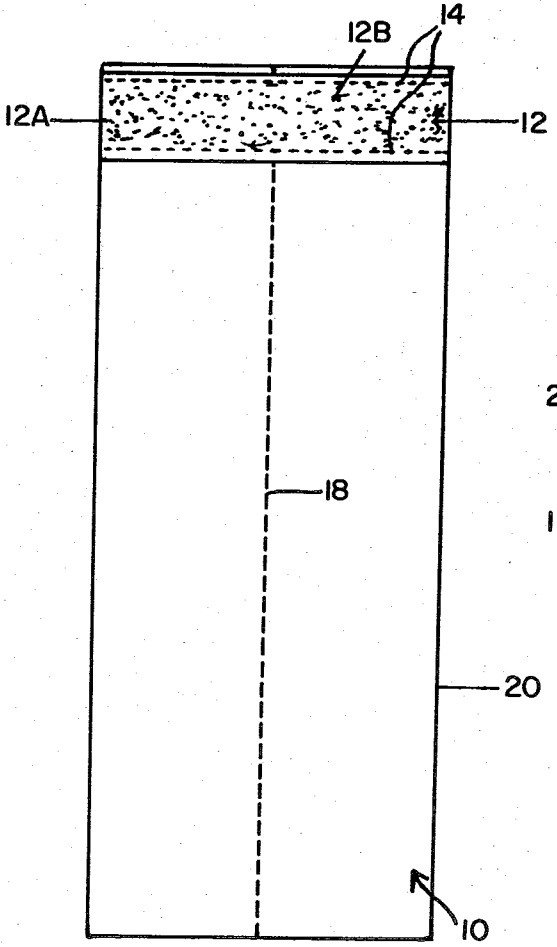
FIG. 2 is a view which is similar to that of FIG. 1 but showing a portion thereof from which a single carrier is formed.

In FIG. 2, one of the carrier bodies with attached fastening means is shown. To form a tubular member therefrom, the blank is folded upon itself along the longitudinal center line 18, and the opposite free edges 20,20 are secured together as by stitching 22 shown in FIG. 3. At the end opposite the fastening means 12 the corners are trimmed, as at 24,24 and the end is closed as by stitching 26. Of course, the edges may be stitched together with fastening means 12 inside the tube, after which the tube is turned inside-out to place the strip of hook material on the outside of the tube, as shown.

Figure 5:
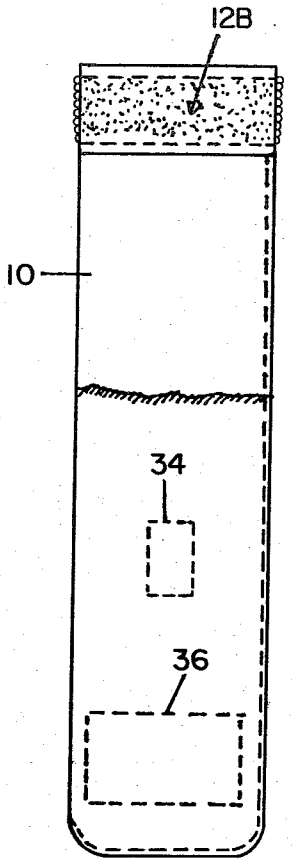
FIG. 5 is a view which is similar to that of FIG. 4 but showing the opposite side of the carrier.
Figure 4:
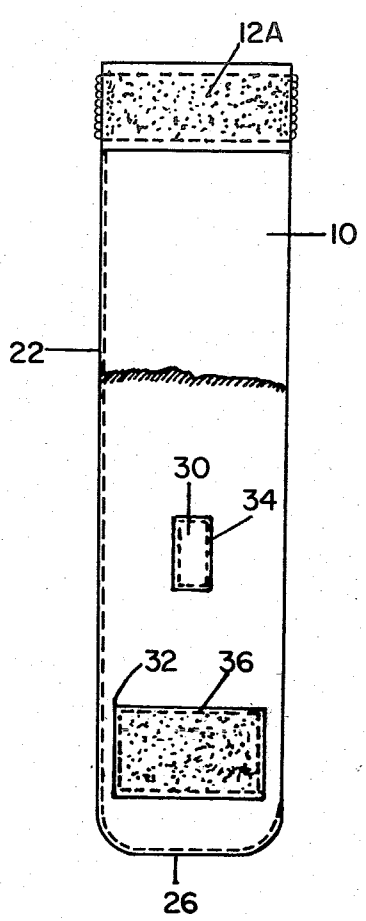
FIG. 4 is a view which is similar to that of FIG. 3 but showing second fastening means attached thereto.

As seen in FIG. 4, complementary fastening means 30 and 32 are attached to one side of the tubular member as by stitching 34 and 36, respectively. The fastening means 30 and 32 comprise short strips of loop material adapted for releasable attachment to the hook material. In use, as described below, the loop fastening member 30 cooperates with a first portion 12A of the hook fastener strip 12 whereas the loop fastener member 32 cooperates with a second portion 12B (see FIG. 5) of the strip 12 at the opposite side of the tube.

Figures 7, 8, 9:
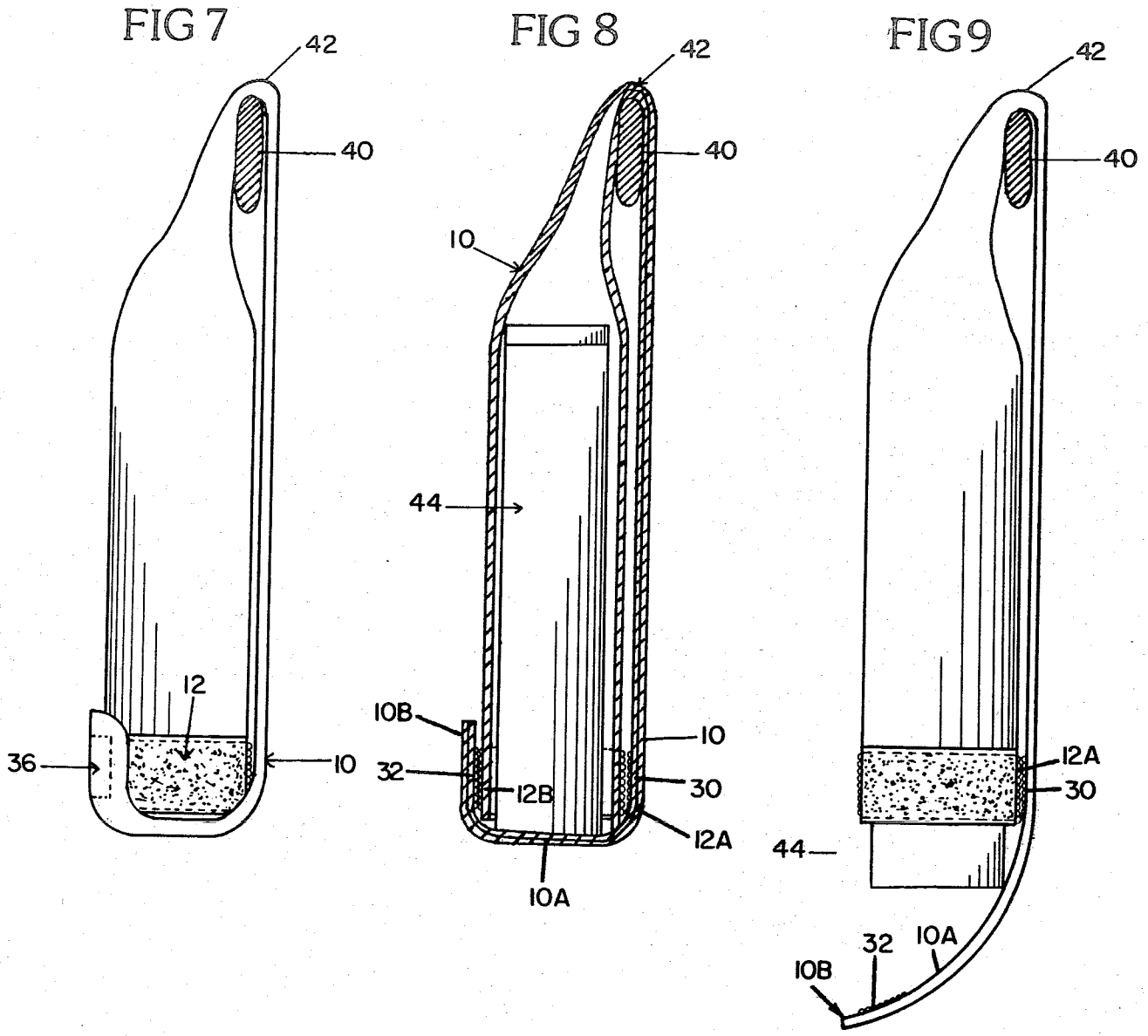
FIG. 7 is a side view of the carrier taken along line 7—7 of FIG. 6.
FIG. 8 is a longitudinal cross-section view of the carrier taken along line 8—8 of FIG. 6.
FIG. 9 is a view which is similar to that of FIG. 7 but showing the closure in open condition and an article falling from the carrier.

The use of the invention is illustrated in FIGS. 6–9 to which Figures reference now is made. The carrier is inserted behind the user's waist belt 40 and folded over the belt along line 42. Cooperating attachment means 12A and 30 are pressed together to releasably secure portions of the tube together in a loop which surrounds the belt, and with the open end of the tube facing downwardly. In this condition, an article to be carried, such as canister 44 may be inserted into the open end of the tube. When fully inserted, as seen in FIG. 8, the open end of the tube is closed by securing loop fastening means 32 to section 12B of hook fastener strip 12. It will be seen that section 10A of the tube functions as a releasable cover, or closure, which supports the article 44 preventing the same from falling from the open end of the tube in the cover-closed condition. For removal of the article 44 from the carrier, the flap, or tab, section 10B of the tube is used to separate the cooperating fastening elements 32 and 12B. With the closure 10A in the open condition, shown in FIG. 9, the article 44 is free to drop from the carrier directly into the hand of the user. By then disconnecting fastening elements 12A and 30, the carrier may be removed from the user's belt without opening the belt buckle.

The invention having been described in detail in accordance with requirements of the Patent Statutes, various changes and modifications will suggest themselves, which changes and modifications are intended to fall within the scope of the present invention defined in the appended claims.

I claim:

1. In a carrier for an article such as a pocket knife, container, or the like, the combination comprising an elongated member comprising a flexible generally rectangular-shaped sheet having opposite side edges and first and second opposite end edges, means for joining said side edges together and opposite halves of said second end edges together to form an elongated tubular member open at said first end to receive an article to be carried and closed at said second end, first releasable fastening means for releasably securing a first portion of the tubular member adjacent said first end thereof to a portion of the tubular member intermediate said opposite ends to form a loop for suspending the tubular member from a waist belt, or the like, worn by a user with the opposite ends of the tubular member extending downwardly, and second releasably fastening means for releasably securing the tubular member adjacent the second end thereof to another portion of the tubular member adjacent said first end thereof to provide a releasable movable closure for the downwardly facing open free end of the member for support of an article in the carrier in the closed condition of the closure.

2. In a carrier as defined in claim 1 wherein said first and second releasable fastening means comprise a band of a first type of securement means surrounding the tubular member adjacent the open free end thereof, and first and second cooperating second type securement means intermediate the opposite ends and adjacent said second end, respectively, of said tubular member releasably attachable to said first type of securement means.

3. In a carrier as defined in claim 1 wherein said first releasably means comprising means for gripping one another upon contact and are separable by pulling.

4. A method of manufacturing a carrier for a pocket knife, container of mace, or the like, comprising, attaching fastening means of a first type along one edge of a rectangular flexible sheet, securing opposite free edges of the sheet together and opposite halves of the edge opposite said fastening means together to provide a tubular member which is open at one end adjacent said fastening means and is closed at the opposite end, attaching fastening means of a second type for cooperative releasable engagement with said first type of fastening means to one side of said tubular member at a first location adjacent the closed end thereof and at a second location intermediate the open and closed ends of the tubular member, the section between said two fastening means of the second type forming a releasable movable closure for the open end of the tubular member.

* * * * *